US005852589A

United States Patent [19]

Wilson et al.

[11] Patent Number: 5,852,589

[45] Date of Patent: Dec. 22, 1998

[54] LOW COST COMPOSITE TRANSDUCER

[75] Inventors: David T. Wilson, Billerica; Roger H. Tancrell, Cambridge, both of Mass.

[73] Assignee: Raytheon Company, Lexington, Mass.

[21] Appl. No.: 570,832

[22] Filed: Jul. 19, 1990

[51] Int. Cl.[6] ..... H04R 17/00

[52] U.S. Cl. ..... 367/157; 367/160; 367/161; 310/334; 310/800

[58] Field of Search ..... 367/157, 160, 367/161, 162, 163, 164, 165, 180; 310/334, 337, 330, 800

[56] References Cited

U.S. PATENT DOCUMENTS

| | | | |
|---|---|---|---|
| 2,045,427 | 6/1936 | White | 381/151 |
| 2,177,629 | 10/1939 | Foster | 381/190 |
| 3,586,889 | 6/1971 | Kolter | 310/329 |
| 4,158,117 | 6/1979 | Quilliam et al. | 200/181 |
| 4,378,721 | 4/1983 | Kaneko et al. | 310/357 |
| 4,395,908 | 8/1983 | Shopland | 367/163 |
| 4,488,873 | 12/1984 | Bloomfield et al. | 433/71 |
| 4,656,384 | 4/1987 | Magori | 310/334 |
| 4,677,337 | 6/1987 | Kleinschmidt et al. | 310/334 |
| 4,709,361 | 11/1987 | Dahlstrom et al. | 367/165 |
| 4,939,405 | 7/1990 | Okuyama et al. | 310/330 |

OTHER PUBLICATIONS

Donald Ricketts, Model for a Piezoelectric Polymer Flexural Plate Hydrophone, J. Acoust. Soc. Am. 70(4), Oct. 1981, pp. 929–935.

*Primary Examiner*—J. Woodrow Eldred
*Attorney, Agent, or Firm*—Glenn H. Lenzen, Jr.; Andrew J. Rudd

[57] ABSTRACT

A composite sensor includes at least one layer comprising a piezoelectric material such as a molecularly poled polymer material or a ceramic material having disposed therebetween a material which enhances the piezoelectric properties of the piezoelectric material. One pair of edges of said composite sensor are constrained from expanding in response to a force applied to the sensor.

30 Claims, 9 Drawing Sheets

$$d_{33} = \frac{Q_3}{F_3}$$

$$d_h = d_{31} + d_{32} + d_{33}$$

LOW COST COMPOSITE TRANSDUCER

BACKGROUND OF THE INVENTION

This invention relates generally to piezoelectric transducers, and more particular to piezoelectric transducers adapted for use in hydrodynamic sonar applications.

As is known in the art, transducers have a wide range of applications including microphones, speakers, force sensors, and hydrophones used to detect sonic energy associated with underwater objects. One type of transducer known in the art uses the piezoelectric properties of a piezoelectric polymer material to produce an electrical signal in response to mechanical stresses applied directly to the material, and corresponding strains produced directly from the applied stress in the piezoelectric material. Sonic transducers may produce an electrical signal responsive to longitudinal pressure waves associated with applied sonic energy or conversely, produce longitudinal pressure waves to provide sonic energy in response to an applied electrical signal. That is, the transducer may act as a transmitter or receiver of sonic energy.

A polymer material suggested for piezoelectric sonic devices is polyvinylidenefluoride (PVDF). Generally, when fabricating transducers of polyvinylidenefluoride to detect hydrodynamic pressures, a sheet of such PVDF material is coated on opposite surfaces with electrically conductive layers. The coated sheet is then submerged in an ocean body to detect sounds emitted by or reflected by underwater objects. These sounds produce pressure waves which produce strains directly in the PVDF material. A voltage is produced across the conductive layers which is related to the piezoelectric characteristics of the PVDF material and is proportional to the strain in the PVDF material, thus detecting such sounds.

One example of a sonic hydrophone for use in detection of sonic energy associated with underwater objects is described in U.S. Pat. No. 4,486,869. This hydrophone includes an elongated tubular structure having a plurality of transducer elements spaced along a common axis by spacer tubers. The elongated tube is comprised of a piezoelectric material such a polyvinylidenefluoride. Electrical terminals are provided in contact with inner and outer curved surfaces of each tuber element to provide the transducers. With this device, longitudinal pressure sound waves impinge directly upon the PVDF element and due to the tubular construction of the element produce external circumferential stresses on the tube to produce a piezoelectric output.

It would be desirable to construct new piezoelectric sensors and transducers which provide higher sensitivity, that is higher electrical output power in response to a predetermined applied force or sonic pressure.

Several techniques are known in the art for increasing the electrical output power of a piezoelectric material. One technique is described in a paper entitled "Model for a Piezoelectric Flexural Plate Hydrophone" by Donald Rickets, Journal of Acoustic Society of America, Volume 70, No. 4, October 1981. In this paper, a sheet of PVDF material is coated on opposite surfaces with electrically conductive layers. To increase the sensitivity of such a transducer, the PVDF sheet having the pair of conductive layers is disposed on a stiff flexural membrane to stiffen the PVDF layer, such as a metal plate having an internal air cavity. The coated, stiffened sheet is then submerged in an ocean body to detect sound waves emitted or reflected by underwater objects. Sound waves impinging upon this transducer produce stresses in the stiffened layers causing strains in the PVDF material. In response, a voltage is produced across the conductive layers which is related to the piezoelectric characteristics of the PVDF material and the applied stress to thereby detect the sound waves.

Because low frequency (i.e. less than 1,000 Hz) sound waves travel over long distances underwater without excessive attenuation and can be heard at long ranges, it is desirable to have sonar transducers which can effectively detect sonic energy at these low frequencies. While the piezoelectric sonic devices described above are useful in many applications, the detection of low frequency signals, i.e. those signals having frequencies below 100 Hz in particular becomes difficult with such devices. In particular, it becomes difficult to achieve high sensitivity below 100 Hz while maintaining high sensitivity above 100 Hz for an appreciable bandwidth without the use of resonant structures. Resonant structures are undesirable because of complexity of construction and further because they in general have a narrow band response. A further problem is that the use of a PVDF polymer piezoelectric device in detection of low frequency sonic signals, generally requires a relatively thick polymer to improve detection, thus increasing the cost of these devices. Moreover, relatively thick layers of polarized PVDF material are difficult to fabricate. Further still, the relatively thick polymer layers induce low frequency resonance effects which are difficult to compensate for in such devices. Thick polymer layers generally also have a lower capacitance compared to thinner layers, which degrades the signal to noise ratio of the hydrophone when coupled to an amplifier.

Moreover, in certain applications for such a device, many hundreds of such transducers may be required. Examples of such application included towed arrays, conformal arrays for ships and submarines and the like. Therefore, approaches which reduce the cost of fabrication of such devices are also desired.

Therefore, it would be desirable to provide a sonic transducer which use a piezoelectric element having an increased sensitivity particularly at lower frequencies without increasing losses or decreasing the capacitance of the transducer. If the sensitivity of the transducer is increased without a corresponding decrease in capacitance, the signal to noise ratio of the transducer should also be improved.

It is further known that raw polyvinylidenefluoride must be treated-or processed to induce or activate the piezoelectric properties of the material. This treatment involves reorientating chains of molecules and polarizing such molecular chains of the PVDF to provide a net polarization of the material. It is known that highest and most useful piezoelectric activity is achieved by the combination of applying a polarizing voltage across the sheet and either compressing the sheet or stretching the sheet under application of heat to lengthen the sheet. It is further known that these steps can occur concurrently or sequentially. The piezoelectric activity of the PVDF sheet having a pair of electrodes disposed over major surfaces thereof is characterized by the tensor relationship given by $d_{3h}=d_{31}+d_{32}+d_{33}$ where $d_{3h}$ is the total or net piezoelectric activity of the sheet in response to a pressure applied to all surfaces of the sheet; $d_{31}$ is the piezoelectric tensor resulting from deformation in the "1" direction (i.e. the direction along which the sheet was lengthened). $d_{32}$ is the piezoelectric tensor resulting from deformation in the "2" direction (i.e. the in-plane direction orthogonal to the lengthening direction) and $d_{33}$ is the peizoelectric tensor resulting from deformation in the "3" direction (i.e. the direction normal to the major surfaces of the sheet). Generally, two of the quantities, the in plane force components $d_{31}$, $d_{32}$, have a positive sign and the out of plane tensor, $d_{33}$, has a negative sign.

The net overall sensitivity is thus reduced for such piezoelectric transducers due to the opposite contributions of the in plane force components to the contribution of the out of plane force component.

A further problem with piezoelectric sonar hydrophones is the requirement that they withstand high static pressure strains resulting from being submerged at significant water depths.

SUMMARY OF THE INVENTION

Set forth herein are further embodiments of force sensors and transducers for hydrophonic applications using the general principles as set out in our copending applications Ser. No. 158,976, filed Feb. 22, 1988 and Ser. No. 300,643, filed Jan. 3, 1989, each assigned to the assignee of the present invention.

We have discovered that force sensors including a molecularly polarized polymer and a pair of low Young's Modulus layers in strain coupling relationship is subject to failure at high static pressures because of tearing of the polymer material. This results because the low Young's Modulus material couples forces to the polymer causing the polymer sheet to compress in response to forces in the "3" direction causing the sheet to stretch in each of the in plane directions.

Lengthening of the polymer sheet, as PVDF for example, as a result of the manufacturing operation to activate the piezoelectric characteristics also reduces the mechanical strength of the sheet in one of the in plane directions.

We have observed that, for sheets which have been stretched, the sheet is generally weakest in the in plane direction orthogonal to the stretched (i.e. lengthened) direction of the sheet.

Conceptually, the PVDF sheet after being stretched may be viewed as containing long chains of moleculus of PVDF disposed in the sheet along the stretched direction. When a tensile force is applied parallel to such stretch direction, the molecules are strained to elongate along the direction. The sheet has a relative high degree of strength in this direction, parallel to the stretched direction because these molecular chains act as reinforcement fibers in the material.

However, when a tensile force is applied across the stretched direction, it pulls the molecular chains away from each other, rather than elongating them, The sheet is subject to tearing at forces less than those which could tear the sheet along the stretched direction.

Thus, for a stretched sheet of PVDF, the in plane direction orthogonal to the stretch direction is the direction in which the sheet is mechanically weakest.

In accordance with the present invention, a device which may be used to sense force or as a transducer element comprises a sheet of a piezoelectric material, such as molecularly polarized polymer, having a predetermined Young's Modulus and a pair of sheets of a material having a Young's Modulus substantially lower than that of the piezoelectric material and a Poisson ratio of about 0.3 to 0.5. The low Young's Modulus material is disposed in strain coupling relationship to opposing surfaces of said sheet of piezoelectric material. The device further includes means for constraining the sheet from straining in an in plane direction corresponding to the mechanical weakest direction of the piezoelectric material.

Generally, for a stretched sheet of PVDF, the mechanically weakest direction of the sheet is the in plane direction orthogonal to the stretched directional of the sheet. Accordingly, the constraining means are disposed to constrain the sheet from stretching in said direction. With such an arrangement, by providing the pair of sheets of low Young's Modulus material in strain coupling relationship to the sheet of piezoelectric polymer material, the low Young's Modulus layers will concentrate strains derived from forces applied to the low Young's Modulus material onto the piezoelectric polymer material, and provide a force sensor or a transducer element having an effective or apparent piezoelectric sensitivity which is higher than the piezoelectric sensitivity of the piezoelectric material alone. By providing a material having a relatively high Poisson ratio, the directional drive of in plane force tensors is reversed, which permits a tensor associated with an unconstrained direction of the sheet to contribute to rather than reduce the overall piezoelectric sensitivity of the sensor. The constraining means prevents the sheet from straining in the direction which the sheet is weakest. This permits the force sensor or transducer element to be exposed to very high static pressures before the sheet tears or rips in response to the static pressure. This makes the element disposed in a transducer housing preferred for deep underwater applications where high hydrostatic pressures will be encountered.

In accordance with the present invention, a transducer element for detection of hydrodynamic pressure includes a rigid housing and force sensor means disposed in said housing, said force sensor means including a piezoelectric material which in response to an applied tensile force is relatively weak in a first direction and relatively strong in a second orthogonal direction. The force sensor further includes means disposed in strain transfer relationship with opposing surfaces of said piezoelectric material, for translating forces applied to the transducer into forces at right angles to the applied force and for producing a strain coupling relationship to the piezoelectric material. The transducer further includes strain relief means disposed between said force sensor means and said housing for permitting expansion of said force sensor means along said second, strong direction, in response to tensile strains. The transducer further includes means for inhibiting said force sensor means from expanding in response to applied tensile strains along said first, weak direction. With such an arrangement, the orthogonal strains produced in said translating means are transferred to the piezoelectric material and one of said strains is redirected to operate on said piezoelectric material so one in plane component tensor of the hydrostatic change sensitivity contributes with the same polarity to producing an output voltage in response to hydrodynamic pressure, thus effectively increasing the hydrodynamic charge sensitivity of the piezoelectric material. The inhibiting means, although preventing expansion of the force sensor along the weak direction of the polymer and thus removing the corresponding component tensor from contributing to hydrostatic charge sensitivity, nevertheless provides a transducer which may be operated and compared to higher hydrostatic pressures since the polymer material is constrained from straining in a direction which corresponds to the weakest direction of the material.

In accordance with a further aspect of the present invention, the force sensor means includes a sheet of non-metalized piezoelectric polymer such as polyvinylidenefluoride and the force translating means is a soft, conductive material disposed in strain coupling relationship to the polymer. Electrical connections are made to the conductive force translating means. The strain relief means is a clearance space, the inhibiting means is a high Young's Modulus material, and a pair of water tight membrances are disposed over the housing to provide a low-cost, water tight transducer which is capable of withstanding significant hydrostatic pressures, while also providing high piezoelectric sensitivity.

In accordance with a still further aspect of the present invention, a thin layer of a strain coupling fluid which allows a slippage at D.C. or very low frequency strains while providing strain coupling at strain frequencies of about 10 Hz and above is disposed between the piezoelectric elements and the elastomer or low Young's Modulus materials. With this arrangement, the layer of strain coupling fluid permits slippage of the elastomer against the piezoelectric at static (D.C.) and very low strain frequencies generated in the elastomers, while permitting such elastomer to couple strains having high frequencies generally about 10 Hz, to the piezoelectric. This provides a hydrophone useful at significant depths in an ocean without potential breakage problems caused by the high hydrostatic pressures.

In accordance with a still further aspect of the present invention, the piezoelectric polymer includes a pair of metalized layers over opposing major surfaces thereof and the force translating means is a non-conductive elastomer. The strain relief means is a clearance space disposed along the stretch direction of the sheet whereas the inhibiting means are sidewalls of the housing also disposed in intimate contact with corresponding edges of the force sensor.

In accordance with a still further aspect of the present invention, the inhibiting means includes said force translating means comprised of a low Young's Modulus elastomer material having high modulus fibers such as glass, carbon, or other suitable fibers disposed in said low Young's Modulus material to restrain such material from expanding in a direction along said fibers. This composite material is disposed in strain coupling relationship to the piezoelectric polymer in such an direction that the elastomer fiber composite restrains the piezoelectric polymer from expanding along its weakest direction. Generally, therefore, the composite is arranged such that the fibers are disposed along the weak direction of the piezoelectric sheet.

BRIEF DESCRIPTION OF THE DRAWINGS

The foregoing features of this invention, as well as the invention itself, may be fully understood from the following detailed description of the drawings, in which.

DESCRIPTION OF THE PREFERRED EMBODIMENTS

Figure 1A:
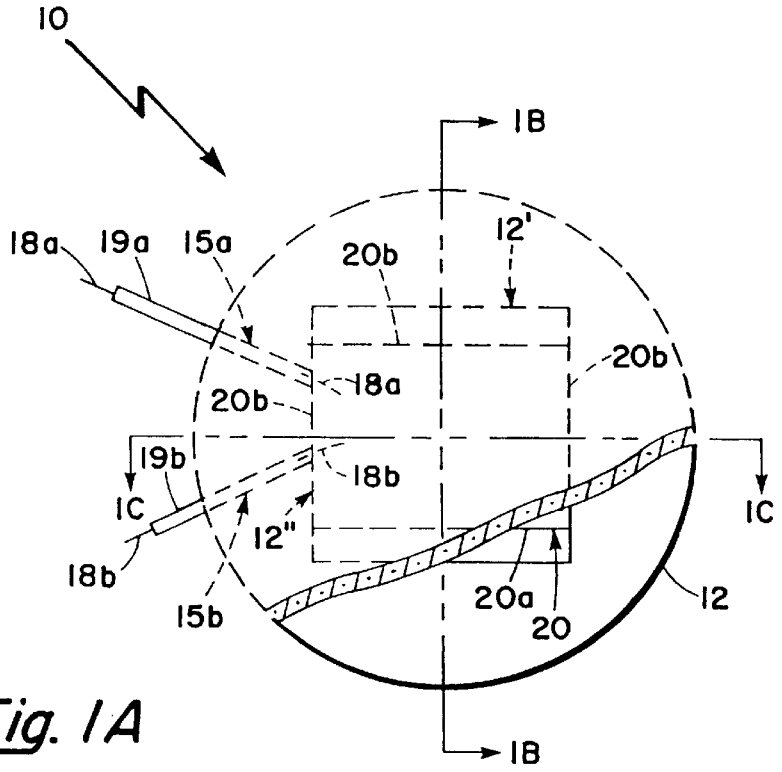
FIG. 1A is a plan view partially broken away of a transducer including a polymer piezoelectric force sensor disposed in a container to detect hydrodynamic pressures.

Referring now to FIG. 1A, a composite transducer 10 is shown to include a composite, stacked force sensor 20 which includes a plurality of sheets 24*a,* 24*b* comprising a piezoelectric polymer material such as polyvinylidenefluoride having interposed therebetween force translating means 22 comprised of sheets 22*a*–22*c* comprised of an elastomer or elastic material.

Transducer 10 further includes a housing 12 comprised of a rigid, stiff material here such polyvinylchloride (PVC) having a rectangular void 12' disposed through a central portion thereof and a pair of membrances 14*a,* 14*b* here of a resilient material, clear PVC. The membrances are thin enough to transmit acoustic pressure changes present in water, for example, into axial compressive forces in the stack 20. The housing 12 is sufficiently rigid to maintain pressure release or strain release spaces 17 between the inner wall of the housing 12 and edges 20*a* of the stack 20, as the stack is compressed and moves outward in response to pressure or force changes while also constraining edges 20*b* of the stack 20 from moving outward in response to such pressure changes.

The elastic or elastomer material of the force translating means is characterized as being softer than the piezoelectric material of sheets 24*a,* 24*b*. Suitable materials include natural rubbers, synthetic rubbers, epoxies, urethanes, vinyls, and composites thereof and other materials having a relatively low Young's Modulus, in which a large strain or distortion is developed in response to an applied stress when compared to the corresponding Young's Modulus of the piezoelectric material. The elastomer of the translating means 22 may be further characterized as having a relatively high Poisson's ratio compared to that of materials generally used to stiffen PVDF layers. Preferably, the elastomer material of the sheets 22*a*–22*c* has a Poisson's ratio in the range of about 0.3 to 0.4 or higher, and a Young's Modulus at least about 1 to 2 orders of magnitude lower than that of the Piezoelectric material of sheets 24*a,* 24*b*. The thicknesses of elastic sheets 22*a*–22*c* are preferably equal and are related to the thicknesses of the piezoelectric sheets 24*a*–24*b* in about the comparable order of which the Young's Modulus of the material of the piezoelectric sheets 24*a*–24*b* exceeds that of the elastic material sheet 22*a*–22*c*.

The peizoelectric material preferable includes molecularly polarized polymers such as polyvinylidenefluoride (PVDF), copolymers including PVDF, and a second polymer such as trifluoroethylene, tetrafluoroethlene, and methylmethacrylate. In general, the peizoelectric material may be of any type in which the material has different tensional strength characteristics to in plane tensional forces.

Figure 1C:
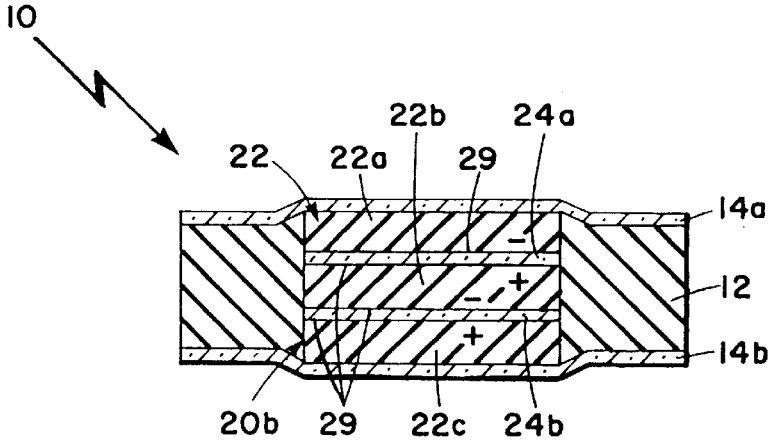
FIG. 1C is a cross-sectional view taken along line 1C—1C of FIG. 1A.
Figure 1B:
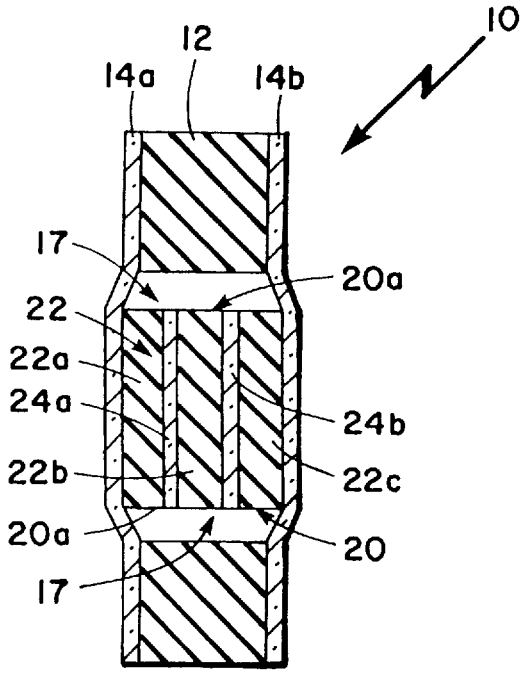
FIG. 1B is a-cross-sectional view taken along line 1B—1B of FIG. 1A.

In the embodiment shown in FIGS. 1A–1C, the peizoelectric layers 22*a*, 22*b* are not coated with conductive electrodes over opposing major surfaces thereof. The electrodes are used to develop an electrical potential across the layers in response to applied pressure waves. Here, conductive elastomers such as, rubbers, urethanes, epoxies, etc. are used to make electrically conductive contact directly to the PVDF. This alone significantly reduces the cost of manufacture since conductive coating of PVDF adds to the cost of the PVDF.

Shear coupling means is required to maintain the elastomers in contact with the piezoelectric sheets. In certain applications, the surface characteristics of the elastomer material (i.e. the tackiness, stickiness, or coefficient of friction of the elastomer surface in contact with the PVDF, for example) provides sufficient shear coupling to the piezoelectric sheets to maintain the elements stacked together and mechanical coupled to provide a force sensor element. Additional shear coupling is provided by clamping of the surface of the layers as will be described.

Further, the elastomer is disposed in direct contact between a positive poled surface of one PVDF layer 22*a* and a negative poled surface of an adjacent PVDF layer 22*b* as shown for layer 22*b*. This arrangement shown in FIG. 1 intrinsically has the PVDF layers 24*a*, 24*b* connected in series without the need for any inter-layer wiring between the two elements.

This arrangement will provide a significant cost savings by eliminating the relatively labor intensive step of inter-layer wiring.

As further shown in FIG. 1A and in particular in comparing of FIGS. 1B and 1C, a strain relief means, here a space (FIGS. 1A, 1B) disposed between force sensor 20 and housing 12. This space accommodates expansion of the force sensor stack 20 in a direction corresponding to the direction in which the PVDF layers 24*a*, 24*b* have their highest strength. A constraining means is disposed against the edges of the force sensor 20 to prevent expansion of the force sensor 20 in a direction corresponding to the weaker of the two in plane directions of the PVDF layers 24*a*, 24*b*. For stretched PVDF, this direction is the in plane direction which is orthogonal to the stretch direction of the PVDF. Here the constraining means is the inner surface of the housing 12 which is abutted directly against that pair of opposing sides of force sensor 20 corresponding to the weak direction of the PVDF material.

As also shown in FIGS. 1B, 1C to further increase resistance to high hydrostatic pressures at significant ocean depths where high hydrostatic pressures are expected to be encountered or to high static pressures when used as a force sensor, a layer 29 of a a.c. strain coupling/d.c. strain slippage fluid is interposed between each of the conductive elastomer layers 22*a*–22*c* and piezoelectric elements24*a*, 24*b* as shown. Under static conditions, the elastomers build up large strains which, if allowed to be coupled to the piezoelectric elements 24*a*, 24*b*, could cause tearing or breakage of the elements 24*a*, 24*b* in the unconstrained direction. Here, the very thin layer 29 of grease is interposed between the elastomer 22*a*–22*c* and the piezoelectric elements 24*a*, 24*b*. The grease permits the elastomer to slip against the elements 24*a*, 24*b* for static and low frequency ( 10 Hz) strains, but couples said strains above about 10 Hz to the piezoelectric elements 24*a*, 24*b* thereby permitting the unconstrained edges of the force sensor to expand within the strain relief space. Silicone vacuum grease from Dow Corning was used as layer 29.

The signal voltages produced by the force sensor element 20 are confined solely to the PVDF material and no signal voltages are across the elastomer. This arrangement eliminates noise due to dielectric losses in the elastomer.

Alternatively, conductively coated PVDF can also be used. The conductively coated PVDF may be used with conductive or non-conductive elastomers, as generally shown in FIG. 2.

Thus, force sensor 20 is disposed within housing 12 and edge 20*a* of force sensor 20 are spaced from the sidewalls 12' of housing 12 by a clearance relief space 17 to enable uninhibited expansion of the force sensor element 20 in response to forces or pressures upon the element 20. The edges 20*b* of the force sensor are constrained from expanding by the intimately disposed sidewalls 12" of the housing 12. This constraint of movement of edges 20*b* substantially reduce tearing of the PVDF in response to high static pressures and eliminates tensional forces in the weak direction of the PVDF as the source of tearing of the PVDF. The transducer 10 has the very thin upper membrance member 14*a* and the very thin lower membrance member 14*b* disposed over respective major surfaces of the force sensor 20 in intimate contact therewith and bonded to the sidewalls of housing 12 with a solvent bond 12, here Bond 50, Green Rubber, Cambridge, Mn. The membranes 14*a*, 14*b* transmit applied force to the force sensor 20 with minimum force loss in the membrances 14*a*, 14*b*. The membrance members 14*a*, 14*b* which are flexible and may be comprised of materials such as rubbers having a typical thickness of 0.1 inches, plastics having a typical thickness of 0.01 inches, and stainless steels having a typical thickness of 0.001 inches permit applied pressure to be transmitted to major central portions of the elastomer sheets, here 22*a*, 22*c* but not the edges of the sheets. Preferably, here clear PVC having a thickness ⅛" is used. Further, the membrance members 14*a*, 14*b* hold the layers together to provide sheer coupling and maintain the elastomer layers and piezoelectric layers together in contact. The housing 12 further includes apertures 15*a*, 15*b*, wires 18, 19 here PVC jacketed 18*b*, 19*b* stranded wires 18*a*, 19*a* which have the wire strands 18*a*, 19*a* interposed in the conductive elastomers 22*a*, 22*c* as shown. The wires are also bonded in place with solvent bonds 18', 19' as shown. Preferably, the height of the housing 12 is chosen in conjunction with the height of the force sensor stack 20 such that the stack can be placed under a slight compression (i.e. mechanical pre-stress) during assembly, thereby insuring intimate contact between the stack 20 and the membrane members 14*a*, 14*b*. Moreover, the device could also be assembled with a slight internal vacuum to insure such intimate contact.

Figure 2:
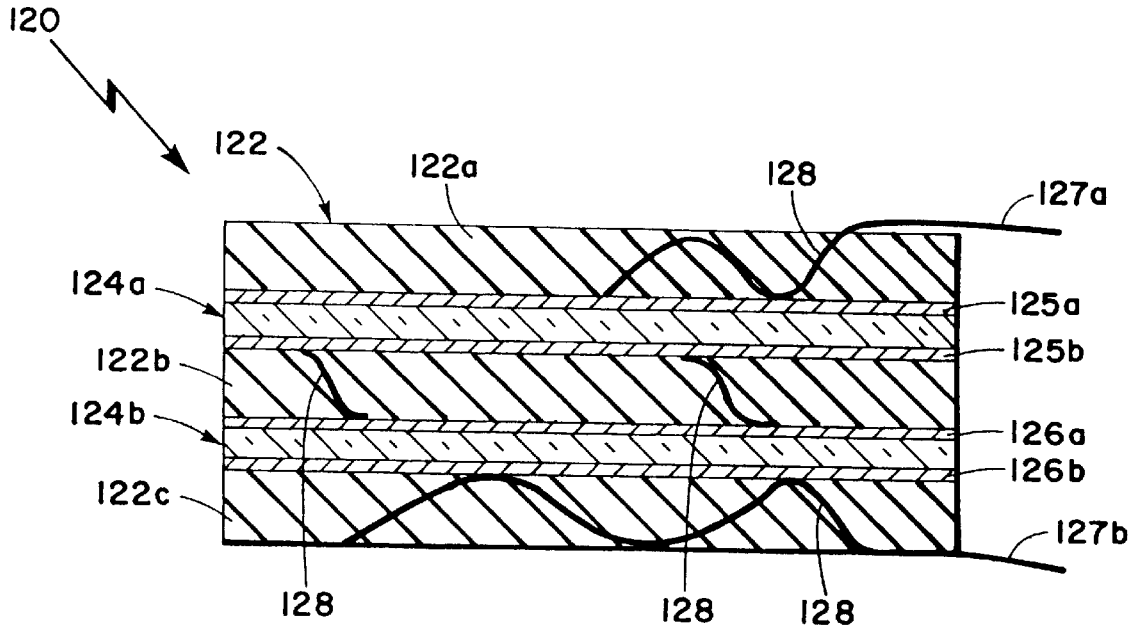
FIG. 2 is a cross-sectional view of an alternate embodiment of the present invention.

Referring now to FIG. 2, a composite stacked force sensor 120 includes a plurality of sheets 124*a*, 124*b* comprising a piezoelectric polymer material such as polyvinylidenefluoride having pairs 125*a*, 125*b* and 126*a*, 126*b* of electrodes disposed on opposing surfaces thereof and having interposed therebetween force translating means 122 comprised of sheets 122*a*–122*c* comprised of here a non-conductive elastomer or elastic material. Woven through sheets 122*a*–122*c* are pieces of thin wire 128 which are used to interconnect the electrodes 125*a*, 125*b* and 126*a*, 126*b* through the non-conductive elastomers and to lead wires 127*a*, 127*b*, as shown.

Force sensor 120 may also be disposed in a housing 12 (FIG. 1A) comprised of a rigid, stiff material here such polyvinylchloride (PVC) having a rectangular void 12' disposed through a central portion thereof and a pair of membranes 14*a*, 14*b* here of a resilient material, clear PVC to provide a transducer 10. Again as described in conjunction with FIG. 1A, when acting as a force sensor, the housing is not provided with membranes 14*a*, 14*b*, but nevertheless would be sufficiently rigid to maintain a pressure release or strain release spaces 17 between the inner wall of the housing 12 and edges of the stack 20, corresponding to the direction along which the stack would expand in its strongest in plane direction (i.e. along the stretched direction of the PVDF sheets 124*a*, 124*b*). The housing (FIG. 1A) would also be arranged such that a second pair of opposing edges (not numbered) corresponding to direction in which the PVDF sheets are weakest (i.e. the in plane direction orthogonal to the stretched direction of the PVDF), as the stack is compressed and moves outward in response to pressure or force changes, would be constrained by the sidewalls of the housing 12 (FIG. 1A).

Figure 3D:
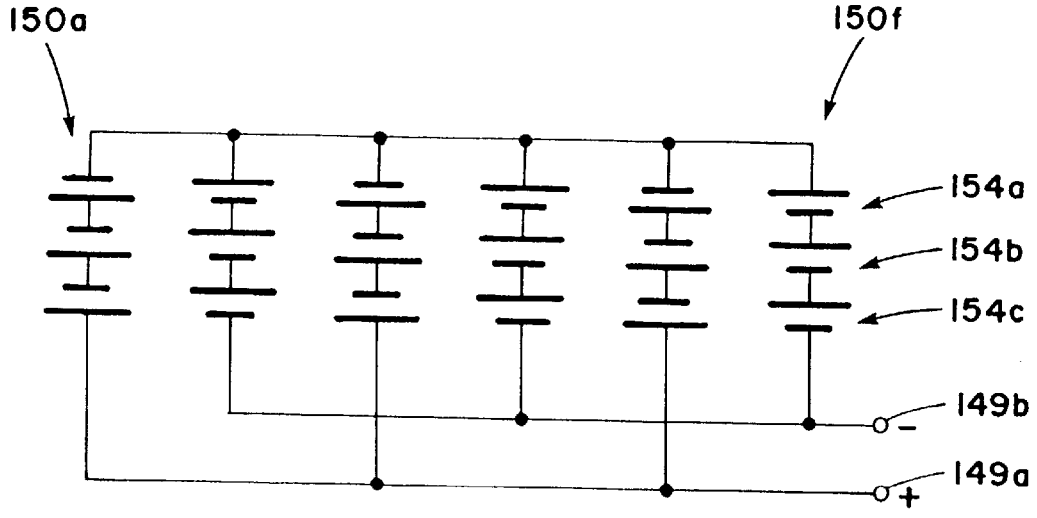
FIG. 3D is a diagrammatical schematic view of the electrical connection of the force sensor shown in FIG. 3A.
Figure 3A:
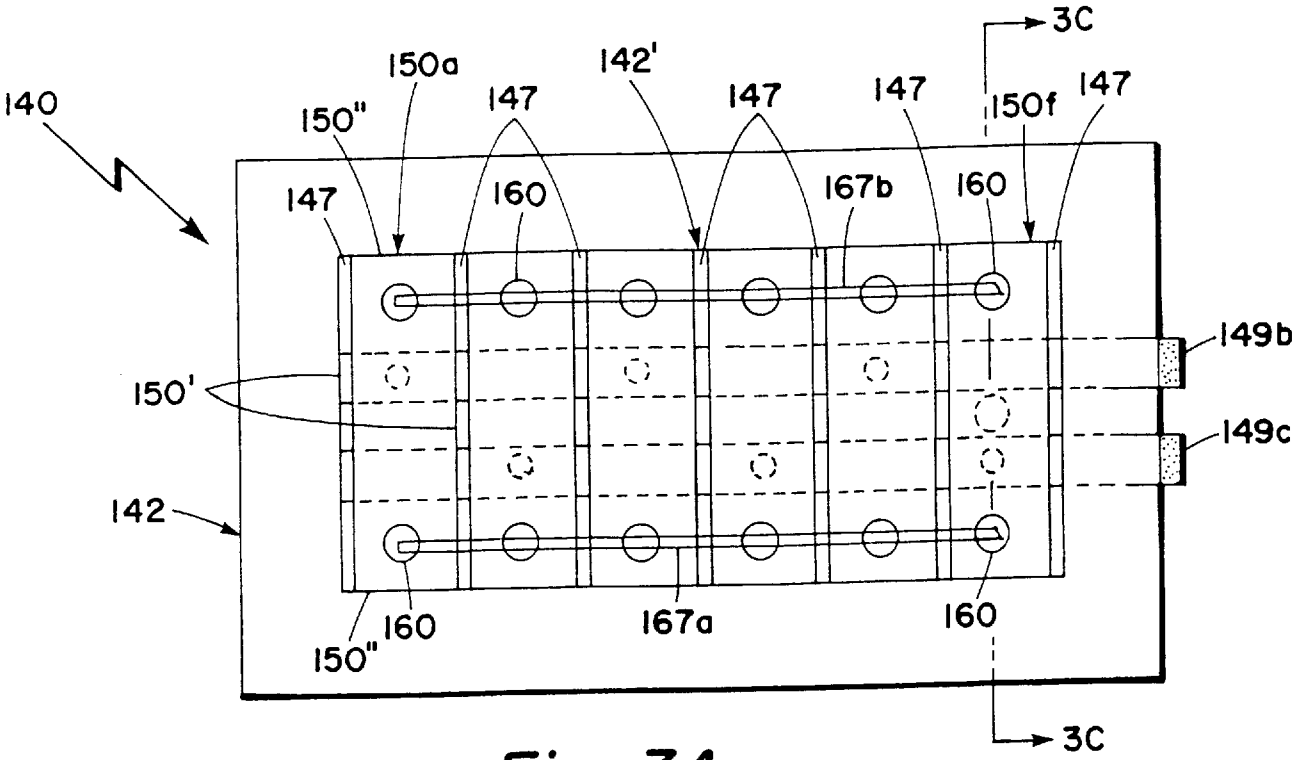
FIG.3A is a plan view of a further embodiment of the present invention.
Figure 3B:
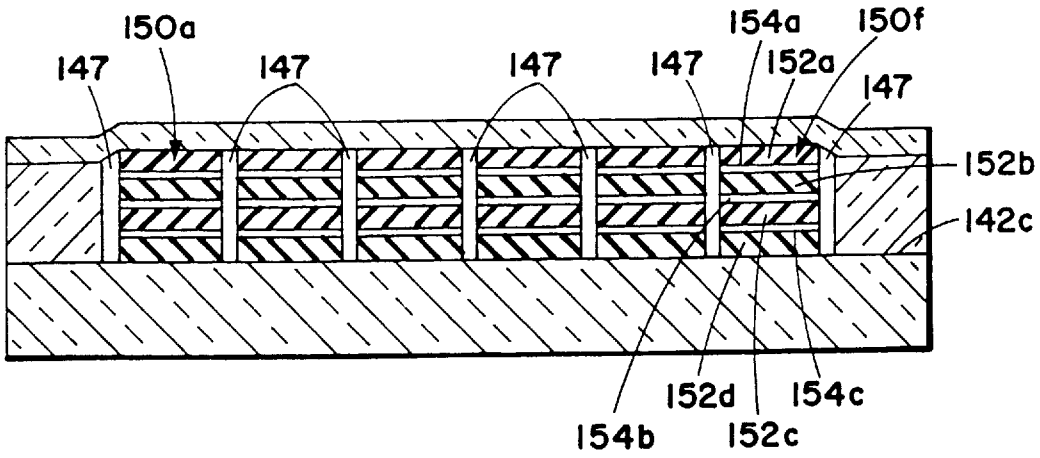
FIG. 3B is a cross-sectional view taken along line 3B—3B of FIG. 3A.
Figure 3C:
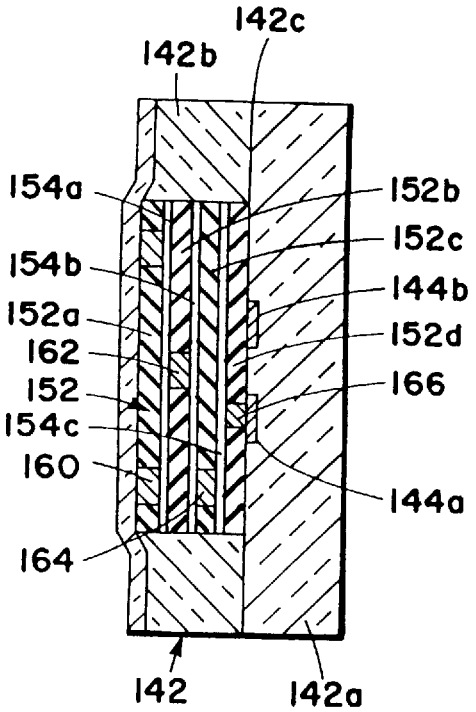
FIG. 3C is a cross-sectional view taken along line 3C—3C of FIG. 3A.
Figures 4A, 4B:
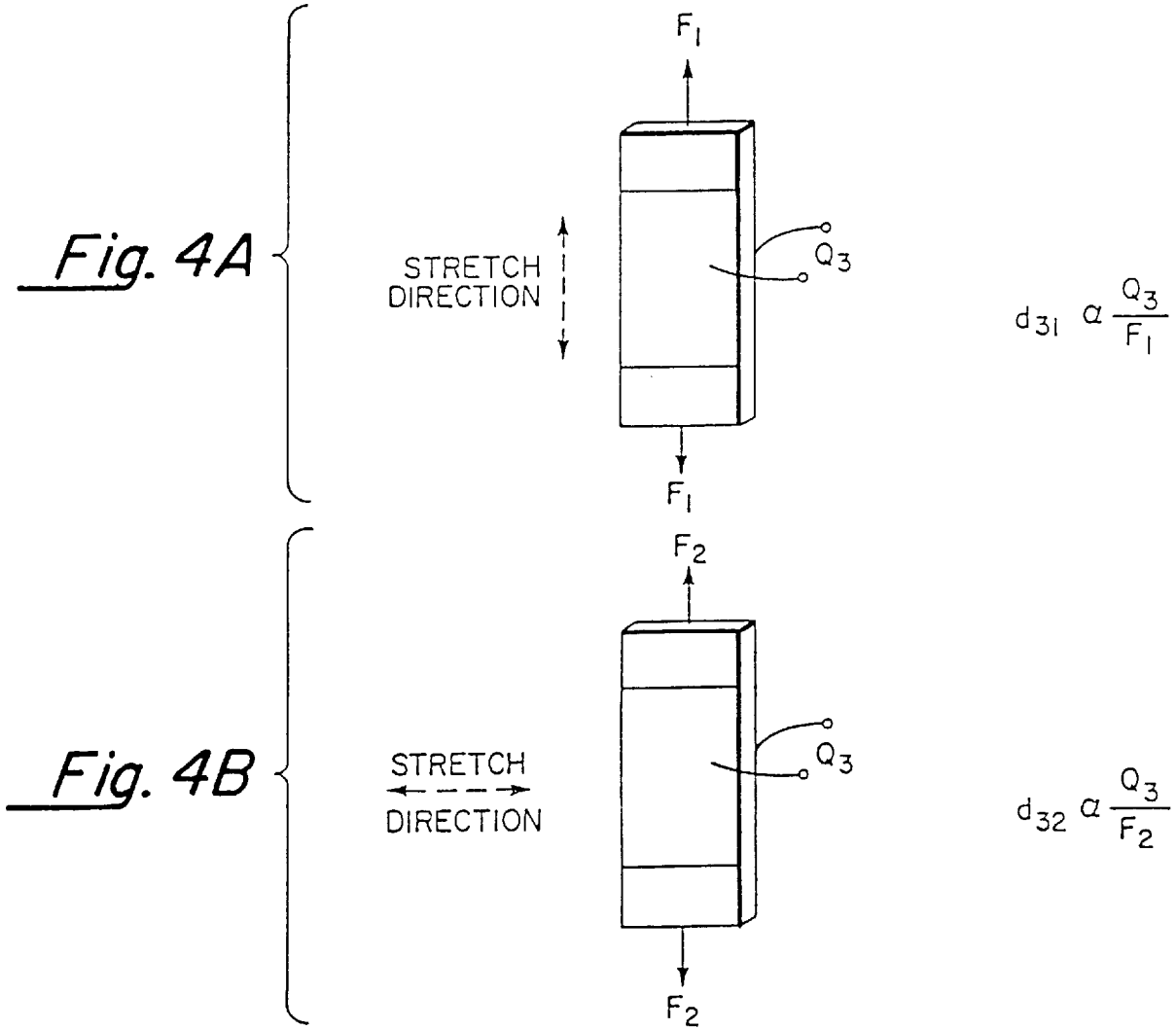
FIGS. 4A–4D are a series of diagrammatical views which shows the relationships between stretch direction and piezoelectric sensors.
Figure 4C:
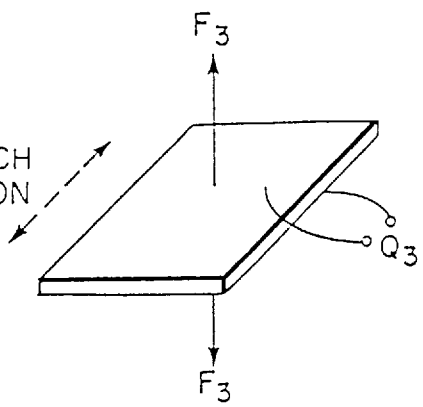
Figure 4D:
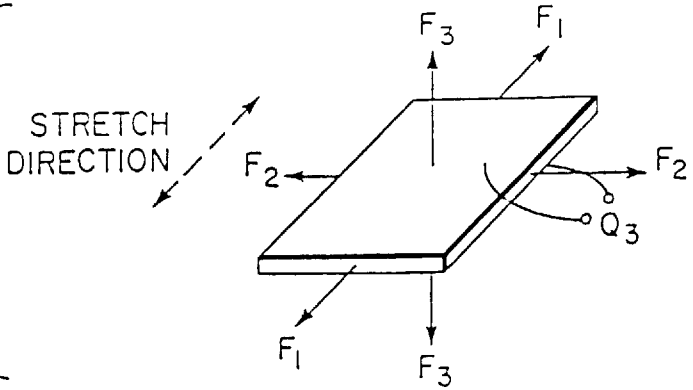

Referring now to FIGS. 3A–3C, an alternate embodiment 140 of a composite transducer is shown to include a plurality of composite, stacked force sensors 150*a*–150*f* here each identical and which each includes a plurality of sheets 154*a*–154*c* comprising a piezoelectric polymer material such as polyvinylidenefluoride having interposed therebetween force translating means 152 comprised of sheets 152*a*–152*d* comprised of an elastomer or elastic material as shown in FIG. 3B for sensor 150*f*.

Transducer 10 further includes a housing 142 comprised of a rigid, stiff material here such polyvinylchloride (PVC) having a base member 142*a* to which is bonded at seam 142*c* a rectangular frame 142*b*, here also of PVC, said seam being here bonded by PVC cement (not numbered). The frame 142*b* provides a rectangular void 142' in which is disposed the force sensors 150*a*–150*f*, as shown. A membrane 144, here of a resilient material, clear PVC is disposed over the force sensors, as shown for example to provide diaphrams to maintain the elements stacked together as is shown, for example in FIG. 1A–1C. The membrane is thin enough to transmit acoustic pressure changes present in water, for example, into axial forces on the stacks 150*a*–150*f*. The housing 142 is sufficiently rigid to maintain pressure release or strain release spaces 147 between the inner wall of the housing 12 and edges 150' of the stacks as shown, for example for stack 150*a* (FIG. 3A), as the stacks are compressed and move outward in response to pressure or force changes while also constraining edges 150", as shown for stack 150*a* (FIG. 3A), of the stack from moving outward in response to such pressure changes. Here the stacks 150*a*–150*f* are slightly higher than the sides of frame 142*b*.

The elastic or elastomer material of the force translating means 152 is characterized as being softer than the piezoelectric material of sheets 154*a*–154*c*. Suitable materials include natural rubbers, synthetic rubbers, epoxies, urethanes, vinyls, and composites thereof and other materials having a relatively low Young's Modulus, in which a large strain or distortion is developed in response to an applied stress when compared to the corresponding Young's Modulus of the piezoelectric material. The elastomer of the translating means 22 may be further characterized as having a relatively high Poisson's ratio compared to that of materials generally used to stiffen PVDF layers. Preferably, the elastomer material of the sheets 154*a*–154*c* has a Poisson's ratio in the range of about 0.3 to 0.4 or higher, and a Young's Modulus at least about 1 to 2 orders of magnitude lower than that of the Piezoelectric material of sheets 154*a*–154*c*. The thicknesses of elastic sheets 152*a*–152*c* are preferably equal and are related to the thicknesses of the piezoelectric sheets 154*a*–154*c* in about the comparable order of which the Young's Modulus of the material of the piezoelectric sheets 24*a*–24*b* exceeds that of the elastic material sheet 22*a*–22*c*.

The piezoelectric material preferable includes molecularly polarized polymers such as polyvinylidenefluoride (PVDF), copolymers including PVDF, and a second polymer such as trifluoroethylene, tetrafluoroethlene, and methylmethacrylate. In general, the piezoelectric material may be of any type in which the material has different tensional strength characteristics to in plane tensional forces.

In the embodiment shown in FIGS. 3A–3C, the piezoelectric layers 154*a*–154*c* are coated with conductive electrodes over opposing major surfaces thereof. The electrodes are used to develop an electrical potential across the layers in response to applied pressure waves. The layers are interconnected by here conductive elastomer plugs 160,162, 164, 166 comprised of conductive rubber, urethanes, epoxies, etc. which are disposed through the elastomer of the force translating means 142 are used to make electrically conductive contact directly to the electrodes (not numbered) in the PVDF. This eliminates the need for weaving wires through the elastomers. Plugs 166 are used to interconnect the stacks to corresponding ones of the pair of bus bars 144*a*, 144*b* here disposed in slots (not numbered) in base 142*a* and comprised of a wide ribbon of copper which extends beyond the housing 140 to provide terminals 149*a*, 149*b*. Any type of interconnection may be made to the ribbons. A pair of woven ribbons 167*a*, 167*b* are disposed to interconnect plugs 160 together, as shown. The pair is used to provide redundancy for the connection made at the diaphrams. Connections may be made by any technique, such as slightly melting the conductive plugs to bond to the wire 167*a*, 167*b*.

Shear coupling means is required to maintain the elastomers in contact with the piezoelectric sheets. In certain applications, the surface characteristics of the elastomer material (i.e. the tackiness, stickiness, or coefficient of friction of the elastomer surface in contact with the PVDF, for example) provides sufficient shear coupling to the piezoelectric sheets to maintain the elements stacked together and mechanical coupled to provide a force sensor element. Additional shear coupling is provided by clamping of the surface of the layers as will be described.

When interconnected as described above, the transducer will have a equivalent electrical schematic, as shown in FIG. 3D where the battery symbol represents the piezoelectric sheet with the short leg of the symbol corresponding to the negative poled surface of the sheet. The stack is connected in series and the plurality is connected in parallel. Since the voltage potential of the top stack are equal the wires 167*a*, 167*b* may be used to interconnect all of the plugs 160 together rather than alternate ones.

As further shown in FIG. 3A and in particular in comparing of FIGS. 3B and 3C, a strain relief means, here spaces 147 (FIGS. 1A, 1B) are disposed between edges 150' of each force sensor 150 and housing 140. The spaces accommodate expansion of the force sensor stacks 150*a*–150*f* in a direction corresponding to the direction in which the PVDF layers 154*a*–154*e* have their highest strength. A constraining means is disposed against the edges 150" of the force sensors 150*a*–150*f* to prevent expansion of the force sensors 150*a*–150*f* in a direction corresponding to the weaker of the two in plane directions of the PVDF layers 154*a*–154*c*. For stretched PVDF, this direction is the in plane direction which is orthogonal to the stretch direction of the PVDF. Here the constraining means is the inner surface of the housing 140 which is abutted directly against the pair of opposing edges 150" of force sensors 150*c*–150*f* corresponding to the weak direction of the PVDF material.

A plurality of stacks are used to keep the dimensions of the stack small in the active direction. This permits a relatively high resonant frequency. Also breaking up the gap between the stacks and the housing prevents the membranes from collapsing into a large gap under high static pressures.

Although not shown in FIGS. 3A–3C to further increase resistance to high hydrostatic pressures at significant ocean depths where high hydrostatic pressures are expected to be encountered or to high static pressures when used as a force sensor, a layer (not numbered) of an a.c. strain coupling/d.c. strain slippage fluid is interposed between each of the conductive elastomer layers 152*a*–152*d* and piezoelectric elements 154*a*–154*c,* as described for FIG. 1A.

Alternatively, uncoated PVDF can also be used. The uncoated PVDF is thus used with conductive elastomers.

Examples of force sensors and transducers having the forementioned high sensitivity or high output energy per unit applied force or pressure per unit area will now be described and high resistance to damage resulting from high static pressures. For the examples to be described urethane was used as the elastomer since it was the strongest elastomer available to us at the time. Other elastomers will work to a greater or lesser extent. Details of each example are given in the following Table.

| EXAMPLE | | | ELASTOMER | | | CON-STRAINED | | dB | STACK FOM $10^{24}$ $V^2$ |
|---|---|---|---|---|---|---|---|---|---|
| Stack | PVDF | | | | Type | OR | FAILURE | Loss/ | F/ |
| or Transducer | No. Layers | Thickness microns | No. Layers | Thickness inches | material softness | UNCON-STRAINED | PRESSURE (PSI) | OPERATING (PSI) | $(\mu Pa)^2$ $m^3$ |
| No. 1 Transducer | 3 | 52 | 4 | ⅛" | Urethane 82 Durom | Unconst. | Over 600 PSI (DNF) | 0 dB @ 300 PSI | 38.3 |
| No. 1 Stack | 3 | 52 | 4 | ⅛" | 82 Durom | Unconst. | failed @ 878 PSI | −.7 dB @ 833 PSI | 34.51 |
| No. 2 Stack | 3 | 52 | 4 | ⅛" | 82 Durom | Const. | over 982 PSI (DNF) | −.9 dB @ 982 PSI | 37.8 |
| No. 2 Transducer | 3 | 110 | 4 | ⅛" | 82 Durom | Const. | over 2000 PSI DNF | 0 dB @ 300 PSI | 37.2 |
| No. 3 Transducer | 3 | 52 | 4 | ⅛" | 82 Durom | Const. | over 2000 PSI DNF | not tested | 45.4 |
| No. 3 Stack | 3 | 52 | 4 | ⅛" | 82 Durom | Const. | failed 3658 PSI (avg. 2 runs) | not tested | not calc. |

All of the Examples were constructed generally in accordance with FIG. 2, using a 52 $\mu$m thick layer of PVDF "KYNAR" obtained from Pennwalt Inc. King of Prussia, Pa. with electrically conductive coatings and the transducer arrangement as generally shown in FIG. 1A, except that the force sensor 120 was used. Transducer No. 2 used 110$\mu$ PVDF and transducer No. 3 is shown in FIGS. 3A–3C. The relevant characteristics for a thin PVDF layer with conductive coatings of silver ink, and without elastic or elastomer layers would be expected to be:

| | | |
|---|---|---|
| C | capacitance | 417 pF/cm$^2$ (for 28 $\mu$m thick film, $\epsilon/\epsilon_0 = 12$ |
| Y,E | Young's modulus $(s_{11}^E)^{-1}$ | $2 \times 10^9$ N/m$^2$ |
| Y,E | acoustic impedance | $2.7 \times 10^6$ kg/m$^2$-s(transverse) |
| Ze | electrical impedance | 1000 Ω) for A = 100 cm$^2$, t = 6 $\mu$m, 1000 Hz) |
| c | elastic modules $c_{11}^E$ | $3 \times 10^9$ N/m$^2$ |
| $d_{31}$ | piezoelectric strain | $23 \times 10^{-12} \frac{m/m}{V/m}$ or $\frac{Coul/m}{N/m}$ |
| $d_{32}$ | | $3 \times 10^{-12} \frac{m/m}{V/m}$ or $\frac{Coul/m}{N/m}$ |
| $d_{33}$ | | $-33 \times 10^{-12} \frac{m/m}{V/m}$ or $\frac{Coul/m}{N/m}$ |
| $d_h$ | | $-7 \times 10^{-12} \frac{m/m}{V/m}$ or $\frac{Coul/m}{N/m}$ |

Example No. 1

For sheets of ⅛ urethane, 82 duromets under the Trademark ACUSHMET ELASTACAST from Greer rubber "½×1" in size were disposed to sandwich and space two layers of polyvinylidenefluoride (PVDF) approximately 52 $\mu$m thick. The urethane sheets and PVDF layers were secured between a pair of ⅛" thick layers of clear, soft PVC which were secured to a housing fabricated from a puck of rigid PVC having an outer diameter of 2 inches and an inner void of 1"×¾" and a height of ½". Two 0.26×0.003" flat copper strips were interposed between the diaphrams and force sensor and woven through the outer layers of the urethane members of the stack.

Figure 5:
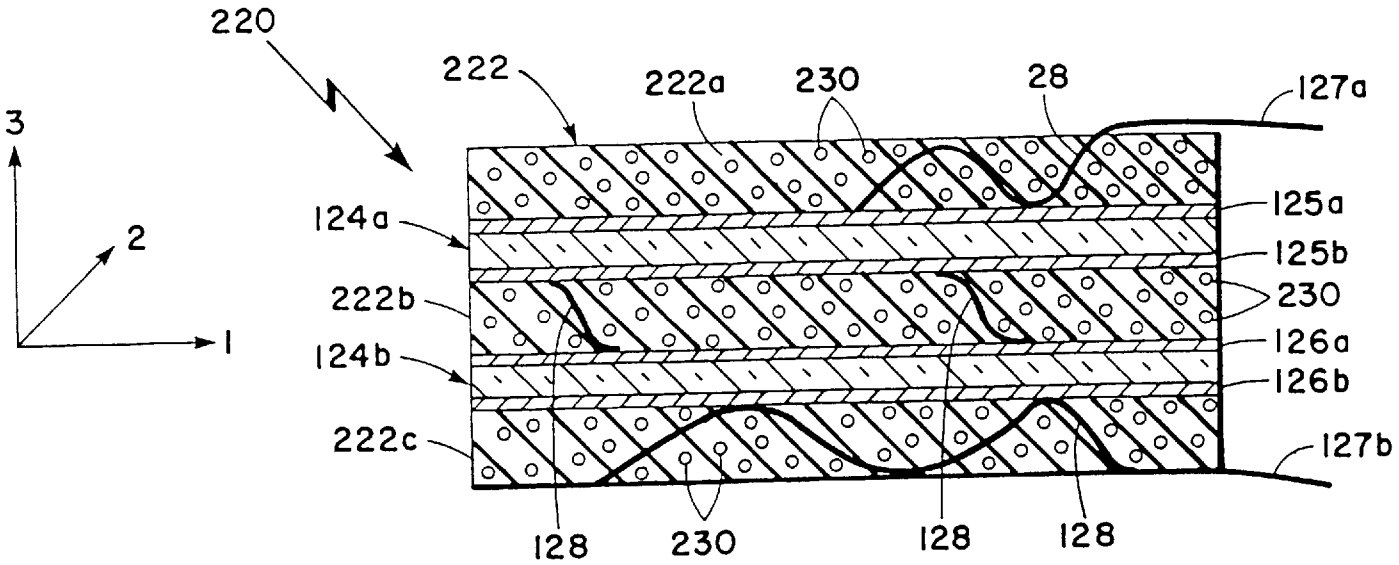
FIG. 5 is a plan view of an alternate embodiment of a constrained force sensor.

Referring now to FIG. 5, an alternate embodiment 220 of force sensor similar to that shown in FIG. 2 is shown. Here, force sensor 220 includes force concentrating means 222 comprised of a plurality of elastomer layers 222*a*–222*c* either conductive or non-conductive materials as discussed above, and each layer further including a plurality of high modulus fibers 230 interspersed through each layer here in a somewhat random pattern, but alternatively in a regular pattern to provide a matrix to stiffen the elastomers in a direction along the length of said fibers 230. Here the elastomers are stiffened along the "2" direction of piezoelectric polymer layer 124*a,* 124*b,* as shown. This arrangement inhibits expansion of said elastomers and hence, piezoelectric polymer layer 124*a,* 124*b* along the 112" or weaker direction of the piezoelectric material Thus, the fibers 230 may be used in place of or together with a restraining or constraining means as discussed above. Preferably, the high modulus fibers 230 are glass, fiberglass, silicon, graphite, stainless steel, Kelvar (Dupont Company, Wilmington Del.) generally known as aramide. As shown, the piezoelectric layers 124*a,* 124*b* are of PVDF and have electrodes 125*a*, 125*b* and 126*a,* 126*b*. The electrodes are interconnected by wires 128 woven through the elastomer layers 222*a*–222*c*. Wires 127*a,* 127*b* are used to provide external interconnections.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. In combination:

a layer comprising a piezoelectric material having a first predetermined Young's Modulus and a pair of in-plane, mutually orthogonal directions in a plane parallel to major opposing surfaces of said layer with said material having a first resistance characteristic to tensional forces applied along a first direction, and a second, lower resistance characteristic to tensional forces applied along a second, orthogonal direction;

means for concentrating onto the piezoelectric material strains derived from forces applied to the concentrating means, said means including a pair of layers of an elastomer material having a second, relatively small Young's Modulus with respect to the Young's Modulus of the piezoelectric material with said layers of small Young's Modulus material with said layers of small Young's Modulus material being disposed over the opposing major surfaces of said layer of piezoelectric material, and means for preventing expansion of said piezoelectric layer along said second, orthogonal direction while permitting expansion of said layer along said first direction.

2. The combination, as recited in claim 1, wherein the material of said concentrating means is selected from the group consisting of conductive rubbers, conductive epoxies, conductive urethanes,conductive vinyls, and conductive composites of said materials.

3. The combination of claim 1 wherein the material of the concentrating means is selected from the group consisting of conductive urethanes and conductive vinyls.

4. The combination of claim 3 wherein said layers of low Young's Modulus material are disposed on the piezoelectric layer to develop a relatively large strain in said piezoelectric layer.

5. The combination, as recited in claim 4, wherein the piezoelectric material is selected from the group consisting of polyvinylidenefluoride, and co-polymers of polyvinylidenefluoride.

6. The combination, as recited in claim 4, wherein the piezoelectric material is polyvinylidenefluoride.

7. The combination, as recited in claim 1, wherein said combination further comprises:

a rigid housing having disposed therein the layer of piezoelectric material and force concentrating means and with said layer of piezoelectric material and force concentrating means having a first pair of opposing edges with said layer of piezoelectric material and force concentrating means arranged therein to provide a strain relief space between sidewalls of said housing and said first pair of opposing edges of said force concentrating means and piezoelectric layer and with a second pair of opposing edges of said piezoelectric material and force concentrating means constrained by sidewalls of said housing.

8. The combination of claim 7 further comprising a pair of thin membranes bonded to said housing and disposed in strain coupling relationship over major opposing surfaces of said force concentrating means.

9. The combination of claim 8 wherein said rigid housing is comprised of a polyvinylchloride cylinder.

10. A transducer comprising:

a rigid housing comprised of rigid polyvinylchloride a force sensor disposed in said housing having first and second pairs of opposing surfaces with said first pair of surfaces disposed in intimate contact with inner surfaces of said rigid housing, said force sensor comprising:

a pair of sheets of an elastomer material; and a piezoelectric material disposed between and directly on said pair of sheets of electrically conductive elastic material;

means disposed over opposite surfaces of said housing for transferring stress applied thereto, to said force sensor; and means disposed between said second pair of edges and said housing for providing strain relief to said force sensor for permitting expansion of said force sensor in a direction orthogonal to said second pair of edges.

11. The transducer of claim 10 wherein said stress transducer means are a pair of thin membranes secured to sidewall portion of said housing in strain relationship to said pair of elastomer sheets.

12. The transducer of claim 10 further comprising means for providing stress relief between the second pair of opposing edges of said force sensor and corresponding sidewalls of said housing.

13. The transducer of claim 12 wherein said piezoelectric material is a polymer.

14. The transducer of claim 13 wherein said means for providing stress relief is a space between corresponding sidewalls of the housing and the second pair of edges of said polymer.

15. The transducer of claim 12 further comprising means for providing dynamic coupling and static slippage between said elastomer sheets and said piezoelectric material.

16. The transducer of claim 15 wherein said dynamic coupling and static slippage means is a layer of grease.

17. In combination:

a layer comprising a piezoelectric material having a first predetermined Young's Modulus and a pair of mutually orthogonal directions in a plane parallel with opposing major surfaces of said layer with said material having a first resistance characteristic to tensional forces applied along a first direction, and a second, lower resistance characteristic to tensional forces applied along a second, orthogonal direction;

means for concentrating onto the piezoelectric material strains derived from forces applied to the concentrating means, said means including a pair of layers of an elastomer material having a second, relatively small Young's Modulus with respect to the Young's Modulus of the piezoelectric material with said layers of small Young's Modulus material being disposed directly on opposing major surfaces of said layer of piezoelectric material, and means for preventing expansion of said piezoelectric layer along said second, orthogonal direction while permitting expansion of said piezoelectric layer along said first direction.

18. The combination, as recited in claim 17, wherein the means for preventing expansion in the second direction while permitting expansion in said first direction comprises said concentrating means having said pair of layers of an elastomer material; and comprises a plurality of high modulus fibers disposed mutually parallel and through said sheets to inhibit said elastomer from expanding along a direction parallel to said length of said fibers and wherein said elastomer sheets are disposed on said piezoelectric layer such that the fibers are disposed along the weaker second direction of the piezoelectric layer while said fibers do not substantially inhibit expansion along the stronger, first orthogonal direction of the piezoelectric layer.

19. The combination of claim 18 wherein the material of the concentrating means is selected from the group consisting of urethanes, rubbers, epoxies, and vinyls.

20. The combination of claim 19 wherein said fibers are selected from the group consisting of glass, fiberglass, silicon, stainless steel, graphite, carbon, and aramide.

21. The combination, as recited in claim 20, wherein the piezoelectric material is selected from the group consisting of polyvinylideneflouride, and co-polymers of polyvinylideneflouride.

22. The combination, as recited in claim 20, wherein the piezoelectric material is polyvinylideneflouride.

23. The combination, as recited in claim 17, wherein said expansion preventing and permitting means has a first pair of opposing edges of said force concentrating means and piezoelectric layers, and further comprises:

a rigid housing having an aperture with sidewalls having disposed therein the layer of piezoelectric material and force concentrating means with first sidewalls of said rigid housing arranged to constrain said first pair of edges from expanding along the second orthogonal direction of said piezoelectric material and while a second, different pair of edges are disposed adjacent second, different sidewalls of said housing and spaced therefrom by a space to permit said sheet to expand in said first direction.

24. The combination, as recited in claim 23, wherein the piezoelectric material is selected from the group consisting of polyvinylideneflouride, and co-polymers of polyvinylideneflouride.

25. The combination, as recited in claim 22, wherein the piezoelectric material is polyvinylideneflouride.

26. The combination of claim 25 further comprising a pair of layers of thin membranes bonded to said housing and disposed over major opposing surfaces of said force concentrating means.

27. The combination of claim 26 wherein said rigid housing is comprised of a polyvinylchloride cylinder.

28. A transducer comprising:

a rigid housing comprised of rigid polyvinylchloride;

a force sensor disposed in said housing comprising:

a pair of sheets of an elastomer material; and a piezoelectric material disposed between said plurality of sheets of elastomer material;

means disposed over opposite surfaces of said housing for transferring stress applied thereto to said force sensor;

means for inhibiting expansion of said force sensor in a first direction corresponding to a mechanically weakest direction of said piezoelectric material; and means disposed between said second pair of edges and said housing for providing strain relief to said force sensor for permitting expansion of said force sensor in a second orthogonal direction.

29. The transducer of claim 28 wherein said inhibiting means are sidewall portions of said housing disposed against edges of said force sensor.

30. The transducer of claim 10 wherein said inhibiting means includes a plurality of high modulus fibers disposed in each of said elastomer layers.

* * * * *